US006647645B2

(12) United States Patent
Kita

(10) Patent No.: US 6,647,645 B2
(45) Date of Patent: Nov. 18, 2003

(54) MIDSOLE STRUCTURE OF ATHLETIC SHOE

(75) Inventor: Kenjiro Kita, Osaka (JP)

(73) Assignee: Mizuno Corporation, Osaka (JP)

( * ) Notice: Subject to any disclaimer, the term of this patent is extended or adjusted under 35 U.S.C. 154(b) by 1 day.

(21) Appl. No.: 09/943,884

(22) Filed: Aug. 31, 2001

(65) Prior Publication Data

US 2003/0000108 A1 Jan. 2, 2003

(30) Foreign Application Priority Data

Jun. 28, 2001 (JP) ..... 2001-196688

(51) Int. Cl.[7] ..... A43B 13/12; A43B 13/18

(52) U.S. Cl. ..... 36/28; 36/30 R; 36/31; 36/37; 36/103

(58) Field of Search ..... 36/28, 30 R, 25 R, 36/31, 27, 35 R, 92, 87, 102, 30 A, 36 A, 37, 71, 44

(56) References Cited

U.S. PATENT DOCUMENTS

| | | | | |
|---|---|---|---|---|
| 1,050,807 | A | 1/1913 | Chamberlain | |
| 2,364,134 | A | 12/1944 | Dow et al. | |
| 2,677,906 | A | 5/1954 | Reed | |
| 4,356,642 | A | 11/1982 | Herman | |
| 4,561,195 | A | 12/1985 | Onoda et al. | |
| 4,774,774 | A | 10/1988 | Allen, Jr. | |
| 4,798,010 | A | 1/1989 | Sugiyama | |
| 4,805,319 | A | 2/1989 | Tonkel | |
| 4,864,737 | A | 9/1989 | Marrello | |
| 4,999,931 | A | 3/1991 | Vermeulen | |
| 5,185,943 | A | 2/1993 | Tong et al. | |
| 5,606,807 | A | 3/1997 | Prepodnik | |
| 5,720,118 | A | 2/1998 | Mayer et al. | |
| 5,799,415 | A | 9/1998 | Kenji et al. | |
| 6,205,681 | B1 | 3/2001 | Kita | |
| 6,219,939 | B1 | 4/2001 | Kita et al. | |
| 6,311,414 | B1 | 11/2001 | Kita | |
| 6,314,664 | B1 | 11/2001 | Kita et al. | |
| 6,401,365 | B2 * | 6/2002 | Kita et al. | 36/28 |

FOREIGN PATENT DOCUMENTS

| | | | |
|---|---|---|---|
| EP | 0857434 | 8/1998 | |
| GB | 2032760 | 5/1980 | |
| JP | 61-6804 | 3/1986 | |
| JP | 11-203 | 1/1999 | |
| JP | 11000203 | * 1/1999 | A43B/13/40 |
| WO | WO 90/06699 | 6/1990 | |

* cited by examiner

*Primary Examiner*—Anthony D. Stashick
(74) *Attorney, Agent, or Firm*—W. F. Fasse; W. G. Fasse

(57) ABSTRACT

A midsole structure for an athletic shoe includes an upper midsole (3) formed of a soft elastic material and disposed from a heel region to a forefoot region of the shoe, a lower midsole (4) formed of a soft elastic material and disposed at least at the heel region of the shoe under the upper midsole (3) and a corrugated sheet (5) sandwiched between the upper and lower midsoles (3, 4) and extending from a heel portion (H) of the upper midsole (3) to a midfoot portion (M). The corrugated sheet (5) has a laterally extending sheet portion (5*a*) and a medially extending sheet portion (5*b*). Edges (50*e*, 51*e*) of the laterally and medially extending sheet portions (5*a*, 5*b*) are overlapped in a band-shape and connected to each other. The edge (51*e*), or a boundary line between the laterally and medially extending sheet portions (5*a*, 5*b*) crosses a load transfer curve ($T_W$) for a heel striker who strikes onto the ground from the heel region of the shoe.

14 Claims, 12 Drawing Sheets

MIDSOLE STRUCTURE OF ATHLETIC SHOE

BACKGROUND OF THE INVENTION

The present invention relates to a midsole structure of an athletic shoe, and more particularly, a midsole assembly having a corrugated sheet therein.

A sole for an athletic shoe used in various sports includes a midsole formed of a soft elastic material to secure cushioning properties and an outsole fitted to the bottom surface of the midsole and directly contacting the ground.

Not only cushioning properties but also running stability are required in an athletic shoe. That is, there is a need to prevent over-pronation or over-supination that causes an excessive lateral or transverse deformation of a shoe sole after striking onto the ground.

As shown in Japanese utility model application publication No. 61-6804 and Japanese patent application laying-open publication No. 11-203, Mizuno Corporation proposed a midsole assembly having a corrugated sheet therein to prevent such an excessive lateral or transverse deformation.

In the midsole assembly described in the above-mentioned publications, a corrugated sheet having a wavy corrugation is disposed in a heel portion of a midsole. Therefore, at the time of striking onto the ground, a resistance force occurs to restrain lateral or transverse deformation of the heel portion of the midsole.

Generally, by inserting a corrugated sheet into a midsole, compressive hardness or hardness with respect to deformation of the whole midsole caused by a vertical compressive force becomes higher, and the midsole tends to be less deformed in the transverse and vertical directions. Therefore, by inserting a corrugated sheet, required cushioning properties on landing are not necessarily achieved at portions that require cushioning properties.

On the other hand, when a relatively lower elastic material is used as a corrugated sheet, cushioning properties are achieved to some extent on landing but lateral deformation after landing may not be fully restrained.

An object of the present invention is to provide a midsole structure of an athletic shoe that can satisfy both stability and cushioning properties.

SUMMARY OF THE INVENTION

A midsole structure of an athletic shoe according to a first embodiment of the invention includes a midsole formed of a soft elastic material and extending from a heel region to a forefoot region of a shoe, and a corrugated sheet disposed at a heel portion and a midfoot portion of the midsole. The flexural rigidity of a medial portion of the corrugated sheet is different from that of a lateral portion of the corrugated sheet.

Generally, as the flexural rigidity of a corrugated sheet increases, the cushioning properties of a midsole on landing decrease but the stability of the midsole improves. In contrast, as the flexural rigidity of a corrugated sheet decreases, the stability of the midsole decreases but the cushioning properties of the midsole on landing improve.

Therefore, by decreasing flexural rigidity of a heel portion of a corrugated sheet at a medial portion (or a lateral portion) that requires cushioning properties on landing, in other words, by increasing flexural rigidity of a heel portion of a corrugated sheet at a lateral portion (or a medial portion) that requires stability after landing, cushioning properties of the midsole on landing can be secured and stability of the midsole after landing can be acquired.

In this case, when the flexural rigidity of the medial portion of the corrugated sheet is made higher than that of the lateral portion of the corrugated sheet, in an athletic shoe such as a running shoe that strikes onto the ground more often from the lateral side, the cushioning properties on landing are secured by the lateral portion of the corrugated sheet having a relatively lower flexural rigidity, and running stability after landing is secured by the medial portion of the corrugated sheet having a relatively higher flexural rigidity, thereby preventing over-pronation.

In contrast, when the flexural rigidity of the lateral portion of the corrugated sheet is made higher than that of the medial portion of the corrugated sheet, in an athletic shoe such as an indoor sports shoe or a tennis shoe that strikes onto the ground more often from the medial side, the cushioning properties on landing are secured by the medial portion of the corrugated sheet having a relatively lower flexural rigidity, and running stability after landing is secured by the lateral portion of the corrugated sheet having a relatively higher flexural rigidity, thereby preventing over-supination.

Preferably, a boundary line between the medial side portion and the lateral side portion of the corrugated sheet crosses a load transfer curve for a heel striker at the midfoot portion of the midsole. The heel striker tends to strike onto the ground from a heel region of a shoe.

Here, when the boundary line between the medial and lateral sides of the corrugated sheet is disposed on the load transfer curve, flexural rigidity of the midsole will change abruptly on opposite sides of the load transfer curve. Thus, the way of deformation of the midsole will abruptly change on opposite sides of the load transfer curve at the time of load transfer, which impedes running stability and makes a shoe wearer feel unpleasant. In contrast, when the boundary line crosses the load transfer curve, the way of deformation of the midsole will not abruptly change on opposite sides of the load transfer curve at the time of load transfer. Thus, running stability can be secured, and cushioning properties and stability can be adjusted according to the actual landing condition.

The boundary line between the medial and lateral sides of the corrugated sheet may cross a load transfer curve for a heel striker in zigzag. In this case, since the midsole comes to deform along the load transfer curve further smoothly, a smooth landing will be possible at the time of striking onto the ground. In addition, deflections of the boundary line from the load transfer curve may be equal or unequal on opposite sides of the load transfer curve.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

<Explanation of the Whole Structure of Athletic Shoe>

Figure 1:
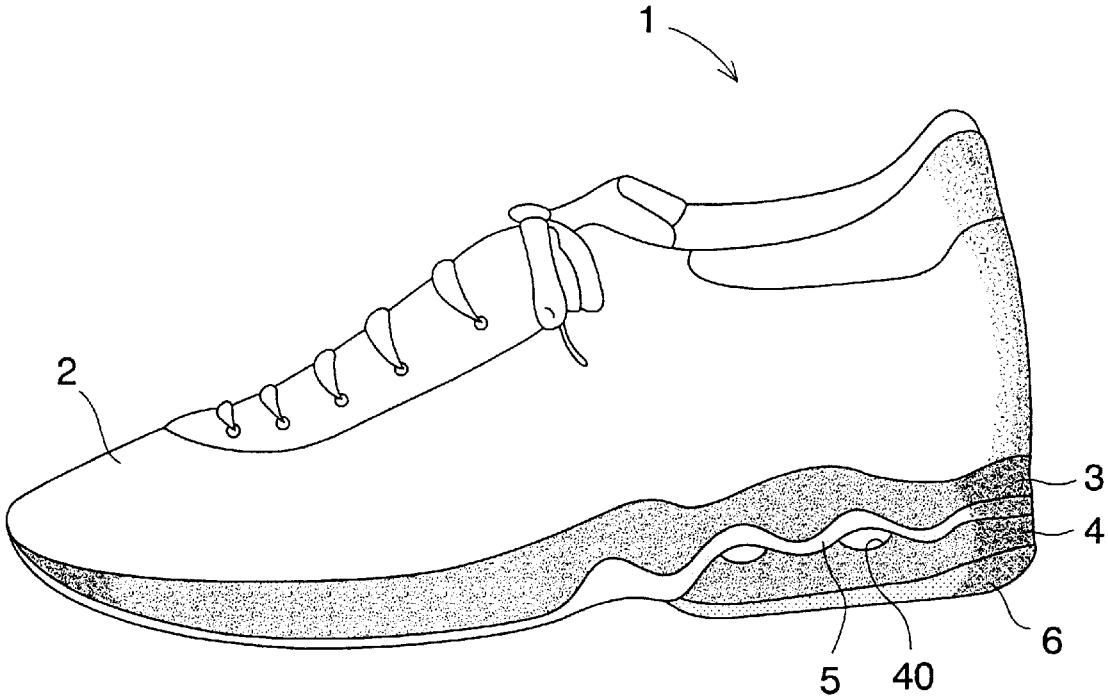
FIG. 1 is a lateral side view of a left athletic shoe employing a midsole structure of one embodiment of the present invention.

Turning now to the drawings, FIG. 1 shows a left athletic shoe employing a midsole structure of one embodiment of the present invention. A sole for this athletic shoe 1 includes an upper midsole 3 extending from a heel region of the shoe to a forefoot region through a midfoot region (or a plantar arch region) and fitted to a bottom of an upper 2, a lower midsole 4 disposed at the heel region of the shoe under the upper midsole 3, a corrugated sheet 5 having a wavy corrugation and disposed between the upper and lower midsoles 3 and 4, and an outsole 6 fitted to a bottom surface of the lower midsole 4 and directly contacting the ground.

The upper and lower midsoles 3, 4 are provided in order to relieve a shock applied to the bottom of the shoe at the time of striking onto the ground and sandwich the corrugated sheet 5 in the vertical direction.

The upper and lower midsoles 3, 4 are generally formed of soft elastic materials having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber are used.

In addition, a plurality of holes 40 extending along the width of the shoe are formed in the lower midsole 4. Each of these holes 40 functions as a cushion hole to improve cushioning properties of the lower midsole 4.

The corrugated sheet 4 is preferably formed of thermoplastic resin such as thermoplastic polyurethane (TPU) of comparatively rich elasticity, polyamide elastomer (PAE), ABS resin or the like. Alternatively, the corrugated sheet 4 is formed of thermosetting resin such as epoxy resin, unsaturated polyester resin and the like.

<Explanation of Midsole Structure>

Figure 2A:
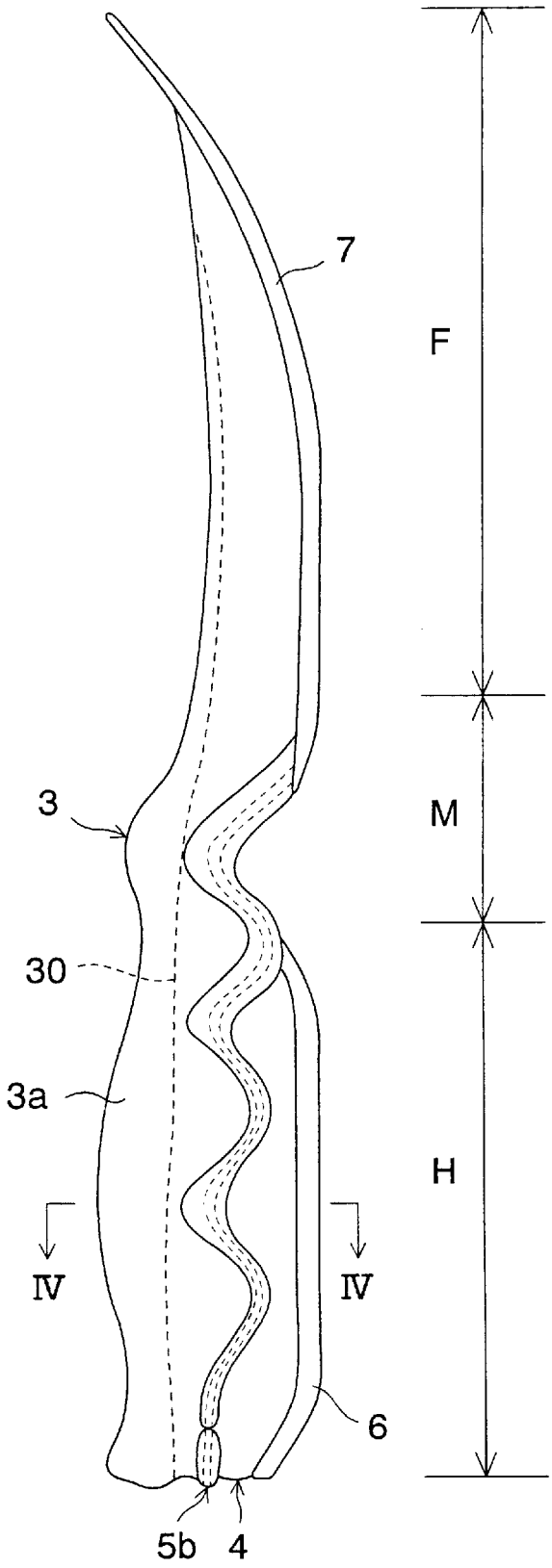
FIG. 2A is a medial side view of the midsole structure of FIG. 1
Figure 2B:
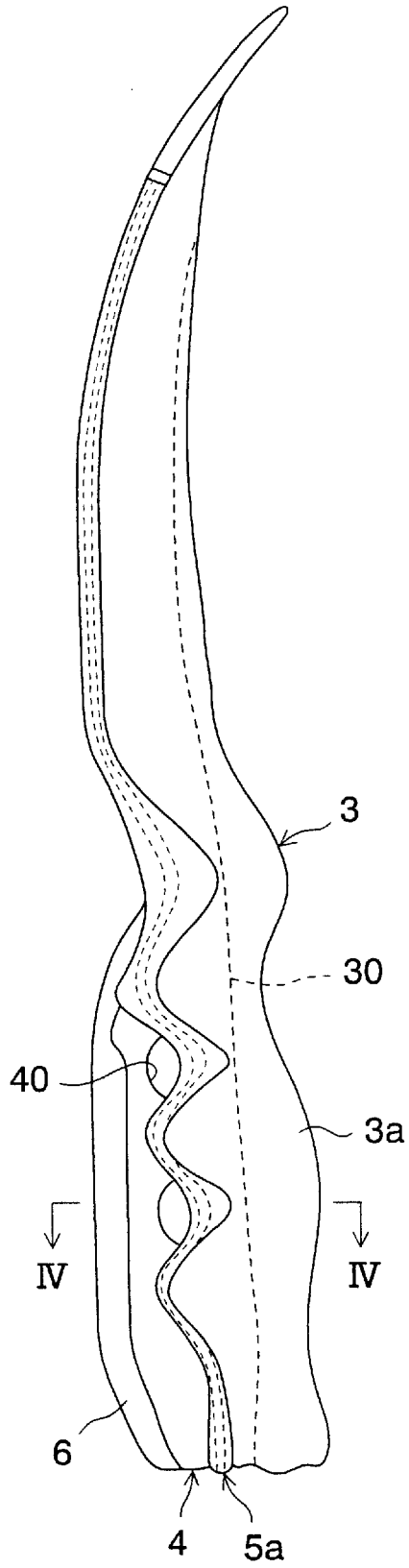
FIG. 2B is a lateral side view of the midsole structure of FIG. 1.

FIG. 2A is a medial side view of a midsole structure and FIG. 2B is a lateral side view of the midsole structure. As shown in FIGS. 2A and 2B, the upper midsole 3 has a heel portion H, a midfoot portion M and a forefoot portion F that correspond to the heel region, midfoot region and forefoot region of the shoe, respectively. The lower midsole 4 is disposed under the heel portion H of the upper midsole 3.

Figure 3:
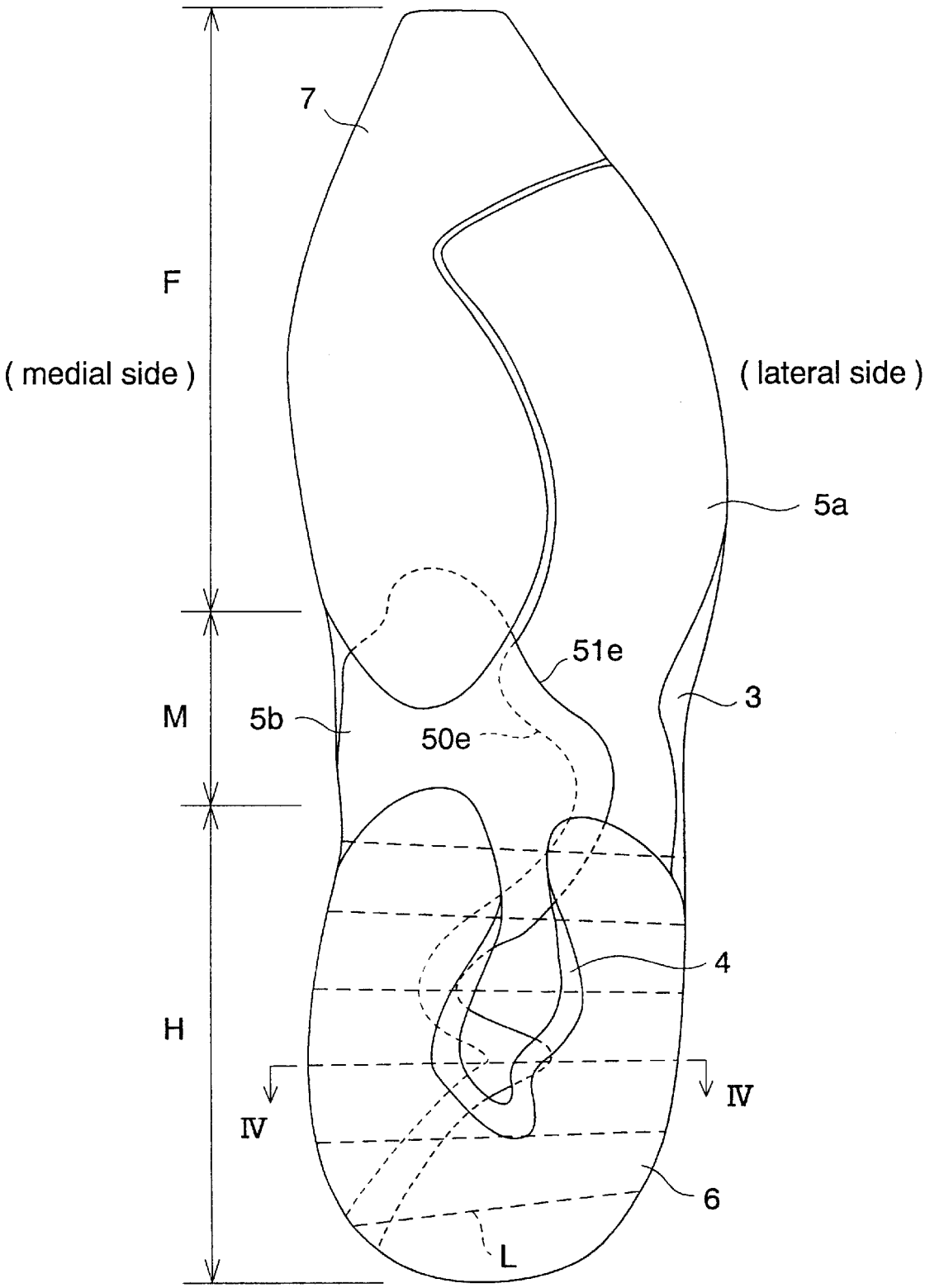
FIG. 3 is a bottom view of the midsole structure of FIG. 1.
Figure 4:
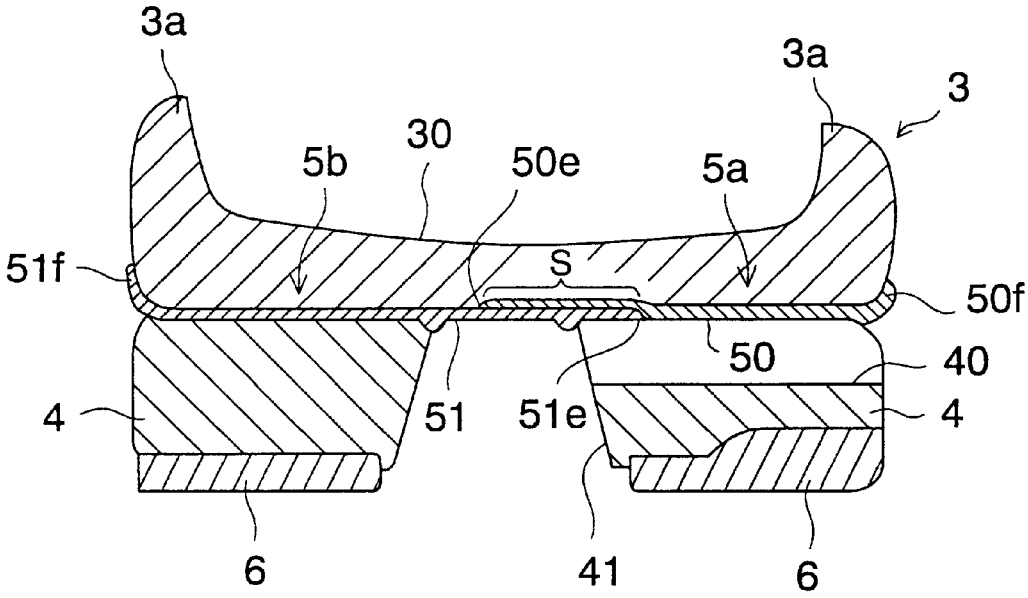
FIG. 4 is a cross-sectional view of FIG. 3 taken along line IV—IV.

FIG. 3 is a bottom view of the midsole structure, and FIG. 4 is a cross sectional view of FIG. 3 taken along line IV—IV. As shown in FIGS. 2A, 2B and 4, the upper midsole 3 includes a base surface 30 to which the bottom of the upper 2 (FIG. 1) is fitted, and a pair of upraised portions 3*a* extending upwardly from opposite ends of the base surface 30. The lower midsole 4 has a through hole 41 extending vertically. The holes 40 of the lower midsole 4 are formed only on the lateral side.

As shown in FIGS. 2A, 2B and 3, the corrugated sheet 5 is formed of a lateral sheet portion 5*a* provided on the lateral side of the upper midsole 3 and a medial sheet portion 5*b* provided on the medial side of the upper midsole 3. The lateral sheet portion 5*a* extends from the heel portion H through the midfoot portion M to the forefoot portion F on the lateral side of the upper midsole 3. The medial sheet portion 5*b* extends from the heel portion H to the midfoot portion M on the medial side of the upper midsole 3. Dotted lines L in FIG. 3 indicate crest lines or trough lines of a wavy corrugation of the corrugated sheet 5.

As shown in FIGS. 3 and 4, an edge portion 50*e* of the lateral sheet portion 5*a* overlaps an edge portion 51*e* of the medial sheet portion 5*b*. The lateral and medial sheet portions 5*a* and 5*b* are connected with each other at an overlapped portion S in a band-shape. The lateral sheet portion 5*a* includes a sheet body 50 extending in the shape of a sheet, and an upwardly extending upraised portion 50*f* disposed at a lateral edge of the sheet body 50. Similarly, the medial sheet portion 5*b* includes a sheet body 51 extending in the shape of a sheet, and an upwardly extending upraised portion 51*f* disposed at a medial edge of the sheet body 51.

The medial sheet portion 5*b* has a relatively lower flexural rigidity as compared to the lateral sheet portion 5*a*. That is, the medial sheet portion 5*b* is formed of a different material from the lateral sheet portion 5*a*, and Young's modulus of elasticity of a material of the medial sheet portion 5*b* is lower than that of a material of the lateral sheet portion 5*a*. Alternatively, the medial sheet portion 5*b* is formed of the same or similar material to the lateral sheet portion 5*a*, but has a smaller thickness than the lateral sheet portion 5*a*. The medial sheet portion 5*b* may be formed of a meshed sheet having a multiple of through holes formed therein.

In order to relatively lower the flexural rigidity of the medial sheet portion 5*b*, the flexural rigidity of the lateral sheet portion 5*a* may be relatively increased. For example, a fiber-reinforced plastic (FRP) sheet may be attached to the lateral sheet portion 5*a*. This fiber-reinforced plastic (FRP) sheet comprises reinforcement fibers and a matrix resin. The reinforcement fibers may be carbon fibers, aramid fibers, glass fibers, Kevlar (TM) fibers or the like. The matrix resin may be a thermoplastic or thermosetting resin. Also, a metallic sheet such as a stainless steel (SUS) sheet, a superelastic alloy sheet, or the like may be attached to the lateral sheet portion 5*a*.

As is clearly seen in FIG. 3, the outsole 6 is provided at the bottom surface of the lower midsole 4 disposed at the heel portion H of the upper midsole 3. The outsole 7 is provided at the medial side and a toe portion of the forefoot portion H of the upper midsole 3.

Figure 5:
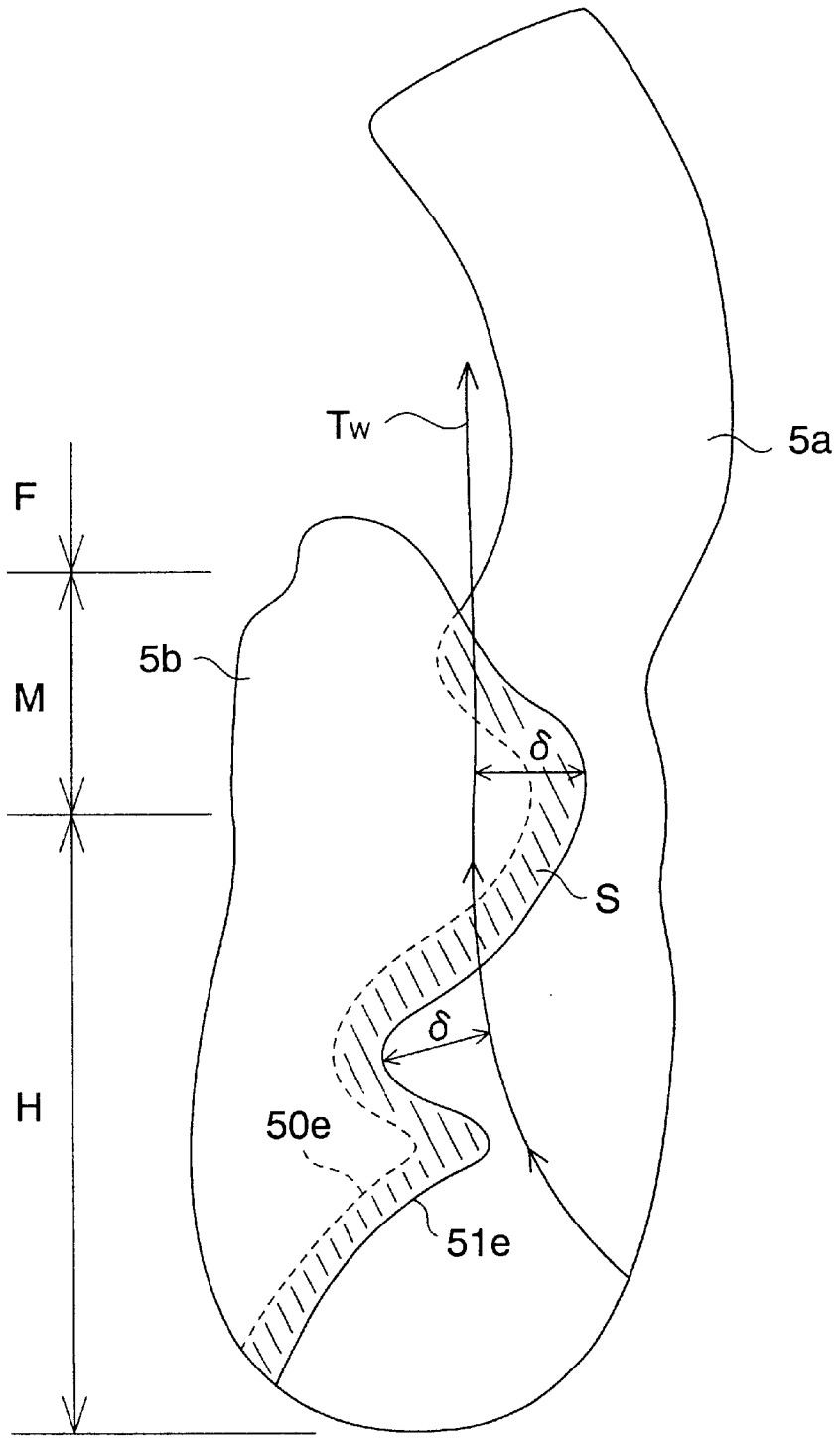
FIG. 5 is a schematic illustrating a corrugated sheet of the midsole structure of FIG. 1 along with a load transfer line.
Figure 6A:
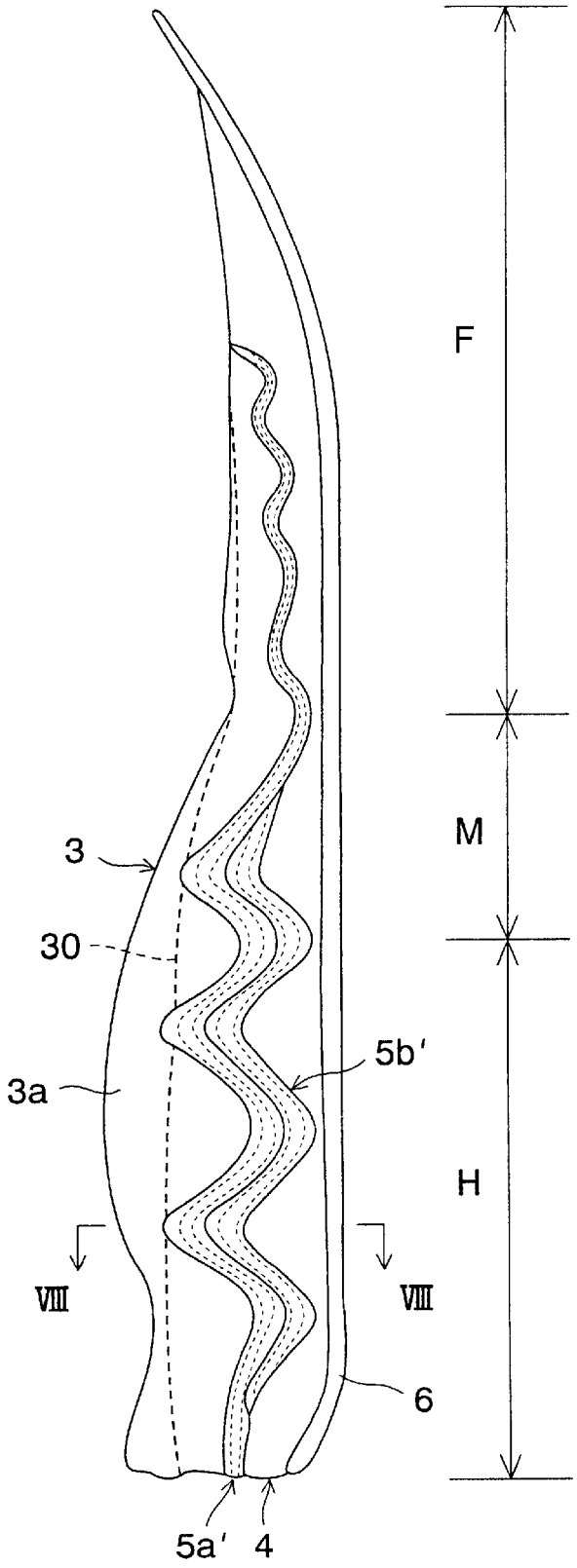
FIG. 6A is a medial side view of the midsole structure of an alternative embodiment of the present invention and FIG. 6B is a lateral side view of the midsole structure of FIG. 6A.
Figure 6B:
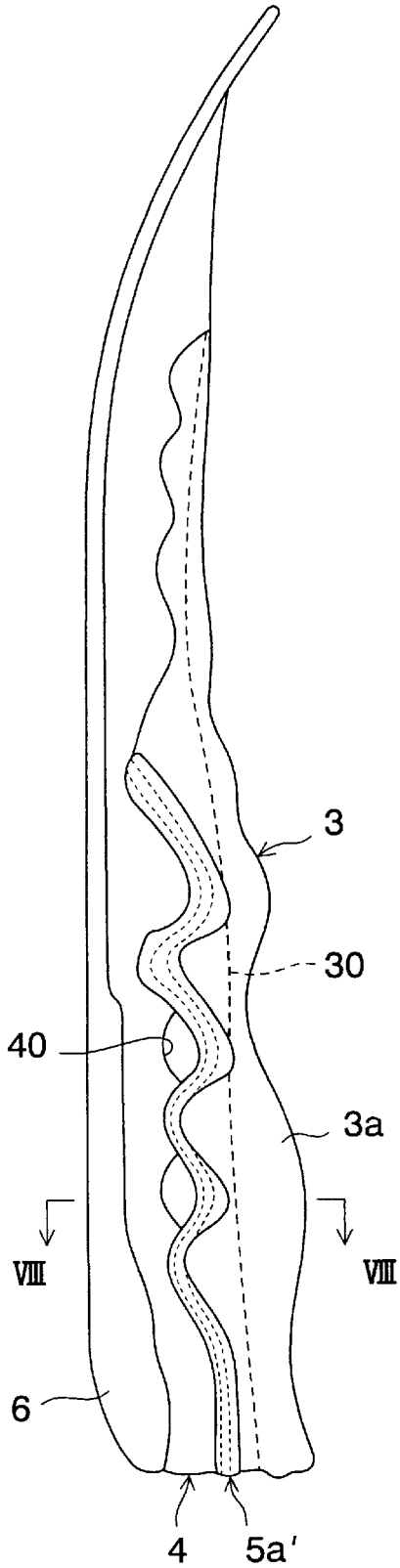
Figure 7:
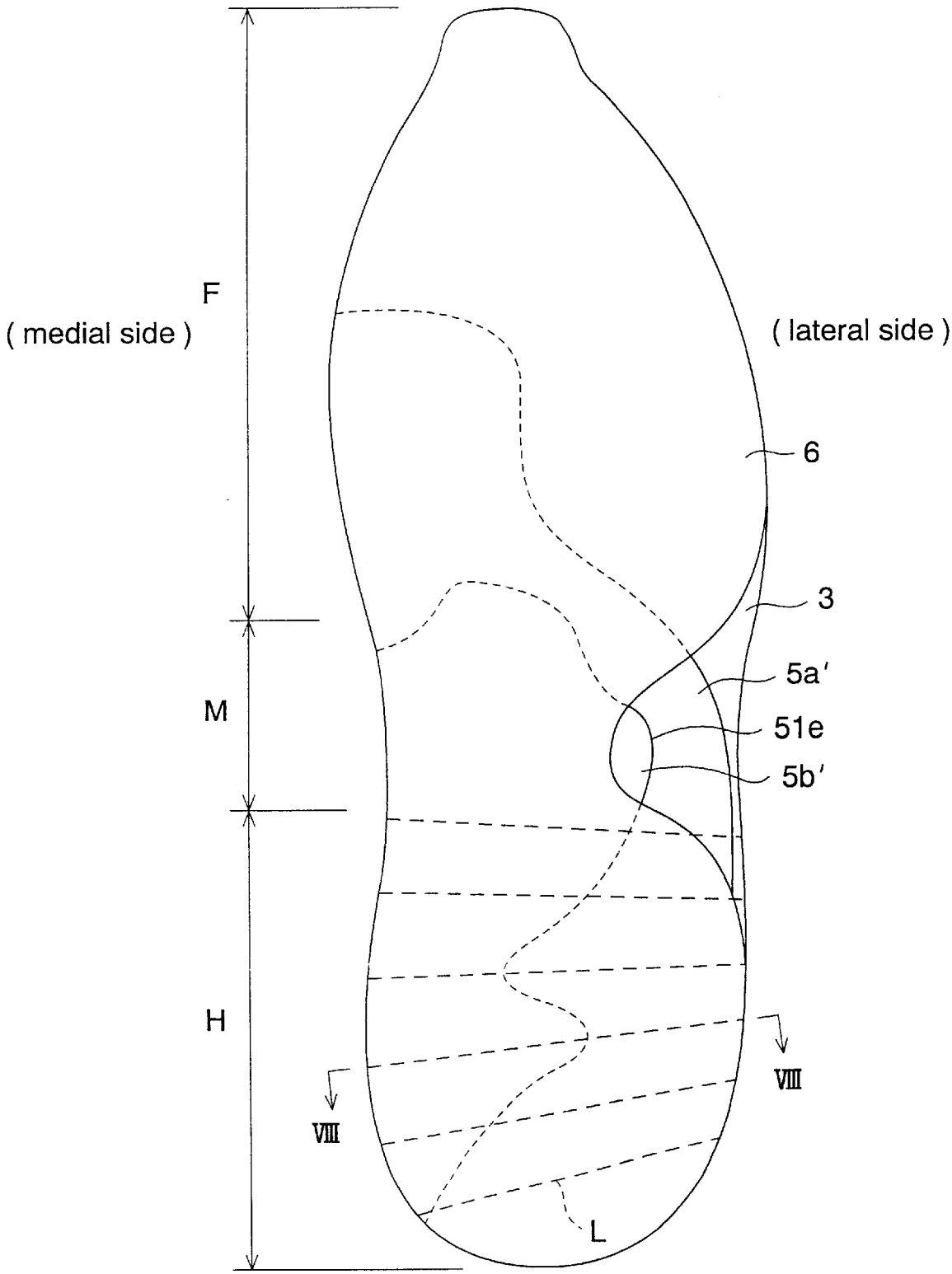
FIG. 7 is a bottom view of the midsole structure of FIGS. 6A and 6B.
Figure 8:
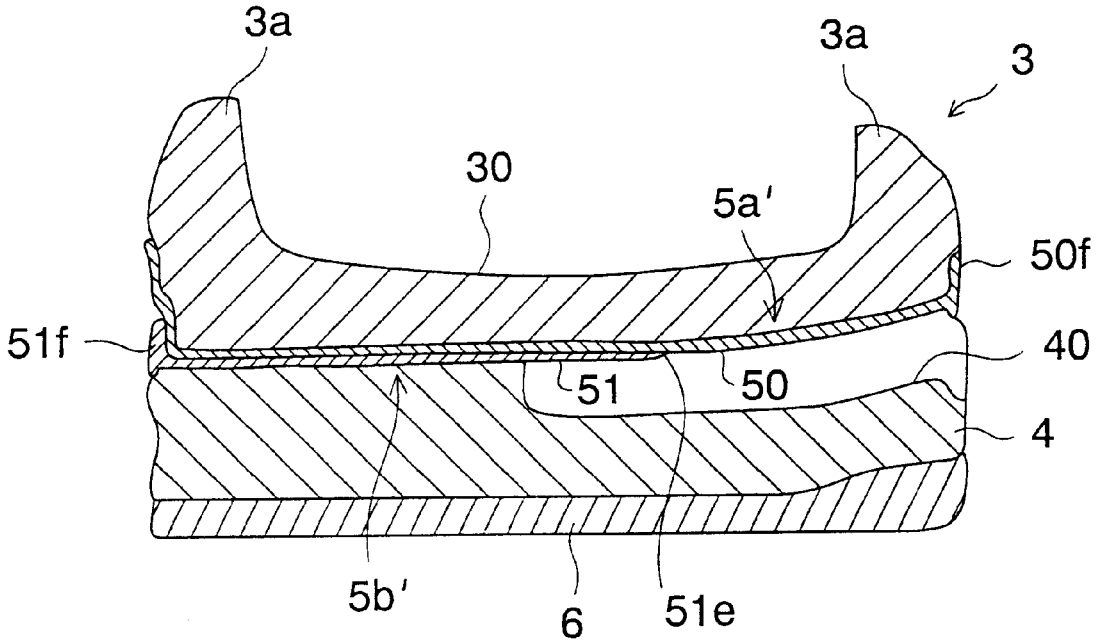
FIG. 8 is a cross sectional view of FIG. 7 taken along line VIII—VIII.

FIG. 5 shows a corrugated sheet of the midsole structure of the present invention. In FIG. 5, an arrow-marked curve $T_W$ indicates a load transfer curve of a runner or a heel striker who strikes onto the ground from a shoe heel portion. The edge portion 51*e* of the medial sheet portion 5*b* forms a boundary line between the lateral sheet portion 5*a* and the medial sheet portion 5*b*. The edge portion 51*e* crosses the load transfer curve $T_W$ at the midfoot portion M and extends generally in zigzag. Also, the boundary line, or the edge portion 51*e* has a generally equal deflection on opposite sides from the load transfer curve $T_W$. That is, deflections δ of the medial and lateral sides are nearly equal.

In this embodiment, as mentioned above, the flexural rigidity of the lateral sheet portion 5*a* is made higher than that of the medial sheet portion 5*b,* that is, the flexural rigidity of the lateral portion of the heel portion and the midfoot portion of the corrugated sheet 5 is higher than that of the medial portion thereof. Thus, in athletic shoes such as an indoor sports shoe, tennis shoe or the like, which strikes onto the ground more frequently from the medial side, cushioning properties can be secured at the medial portion at the time of landing and stability can be achieved at the lateral portion after landing, thereby preventing over-supination.

In addition, if the boundary line between the medial sheet portion and the lateral sheet portion of the corrugated sheet 5, e.g. the edge portion 51*e* of the medial sheet portion 5*b* in this embodiment, extends on and along the load transfer curve $T_W$, the flexural rigidity of the midsole will change abruptly on opposite sides of the load transfer curve $T_W$. Thus, the way of deformation of the midsole will change abruptly when a load crosses the boundary line during load transfer, which impedes running stability and makes a shoe wearer feel uncomfortable. In contrast, as shown in FIG. 5, the boundary line crosses the load transfer curve $T_W$, during load transfer along the load transfer curve $T_W$, the way of deformation of the midsole will not change abruptly on opposite sides of the load transfer curve $T_W$. Thus, running stability is achieved and cushioning properties and stability suitable for actual landing condition can be adjusted.

Moreover, in this case, since the boundary line between the medial and lateral sheet portions of the corrugated sheet 5 crosses the load transfer curve $T_W$ in zigzag, the midsole comes to deform more smoothly along the load transfer curve $T_W$, thereby enabling a smooth landing at the time of striking onto the ground.

<Alternative Embodiment>

Next, a midsole structure of an alternative embodiment of the present invention will be explained using FIGS. 6A to 9, each corresponding to FIGS. 2A to 5.

In this embodiment, a corrugated sheet 5 is formed of a sheet body 5*a*' that covers nearly entire region of a heel portion H and a midfoot portion M of an upper midsole 3, and a medial sheet portion 5*b*' that covers a medial portion of the heel portion H and the midfoot portion M of the upper midsole 3 and the entire portion thereof is attached to the sheet body 5*a*'. That is, in this case, the medial portion extending from the heel portion to the midfoot portion of the corrugated sheet 5 has a double sheet structure where two pieces of corrugated sheets are overlapped. A lower midsole 4 extends from the heel portion H to the forefoot portion F through the midfoot portion M of the upper midsole 3. An outsole 6 extending along the entire length of a shoe is fitted to the bottom surface of the lower midsole 4.

The medial sheet portion 5*b*' may be formed of material having a relatively higher or lower flexural rigidity, or having the same flexural rigidity. In any case, since the medial portion of the corrugated sheet 5 has a double sheet structure with the sheet body 5*a*', the flexural rigidity of the medial portion is higher than that of the lateral portion.

Figure 9:
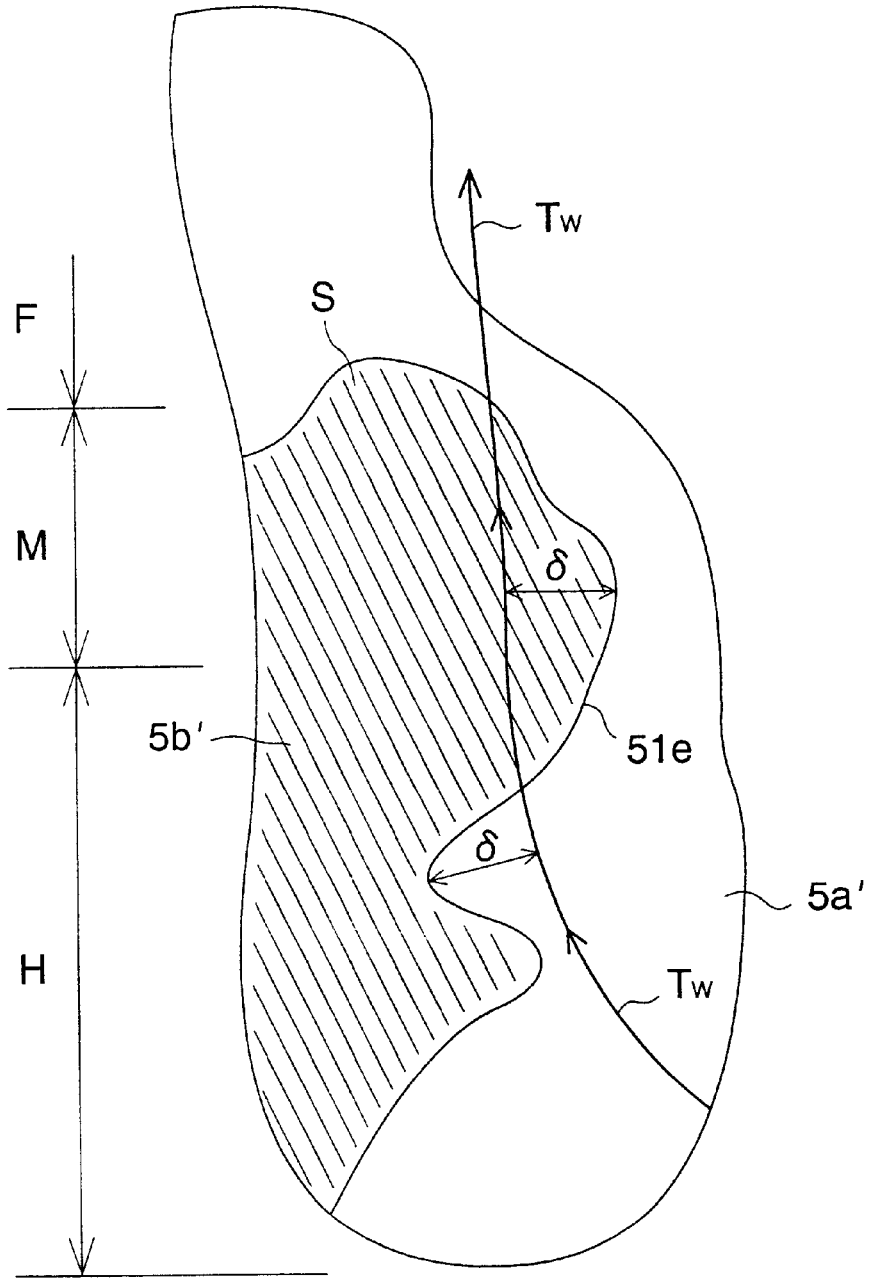
FIG. 9 is a schematic illustrating a corrugated sheet of the midsole structure of FIGS. 6A and 6B along with a load transfer line.

In FIG. 9, an arrow-marked line $T_W$ indicates a load transfer curve of a heel striker or runner who strikes onto the ground from a shoe heel portion. As shown in FIG. 9, a boundary line between the sheet body 5*a*' and the medial sheet portion 5*b*', or an edge portion 51*e* of the medial sheet portion 5*b*' crosses the load transfer curve $T_W$ at the midfoot portion M and extends generally in zigzag. A deflection δ of the boundary line or the edge portion 51*e* is made nearly equal on opposite sides of the load transfer curve $T_W$.

According to this embodiment, as above-mentioned, the flexural rigidity of the medial side at the heel and midfoot portions of the corrugated sheet 5 is higher than that of the lateral side. Thus, in the case of especially, running shoes that strikes onto the ground from the heel lateral portion, cushioning properties on landing can be secured at the lateral side and stability after landing can be achieved at the medial side, thereby preventing over-pronation.

Also, the boundary line between the medial and lateral sheet portions of the corrugated sheet, or an edge portion 51*e* of the medial sheet portion 5*b*' crosses the load transfer curve $T_W$. Thus, the way of deformation of the midsole will not change abruptly on opposite sides of the load transfer curve $T_W$ at the time of load transfer along the load transfer curve $T_W$. As a result, running stability can be secured, and cushioning properties and stability comes to be adjusted according to the actual landing condition.

Moreover, in this case, since the boundary line between the medial and lateral sheet portions of the corrugated sheet 5 crosses the load transfer curve $T_W$ in zigzag, the midsole comes to deform still more smoothly along the load transfer curve $T_W$, thereby enabling a smooth landing at the time of striking onto the ground.

<Variants of Boundary Line>

In the above-mentioned embodiments shown in FIGS. 5 and 9, the boundary line between the medial and lateral sheet portions of the corrugated sheet 5 crosses the load transfer curve $T_W$ mainly at the midfoot portion M, but the present invention is not limited to these embodiments.

Figure 10:
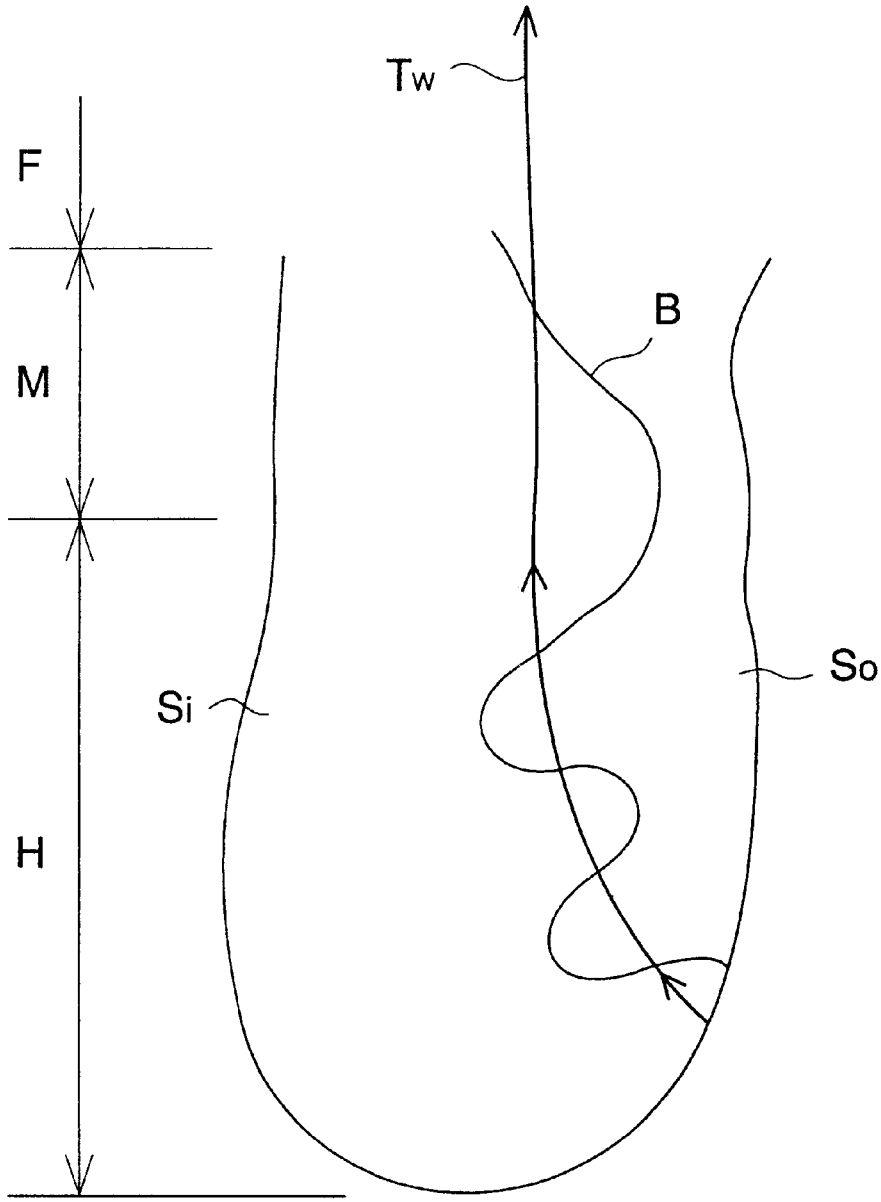
FIG. 10 illustrates a first variant of a boundary line between a medial sheet portion and a lateral sheet portion of the corrugated sheet and corresponds to FIGS. 5 and 9.

FIG. 10 illustrates a first variant of a boundary line. As shown in FIG. 10, a boundary line B between the medial sheet $S_i$ and the lateral sheet $S_o$ crosses the load transfer curve $T_W$ in zigzag not only at a midfoot portion M but also at a heel portion H. Also, deflections of the boundary line B on opposite sides of the load transfer curve $T_W$ are not equal to each other.

Figure 11:
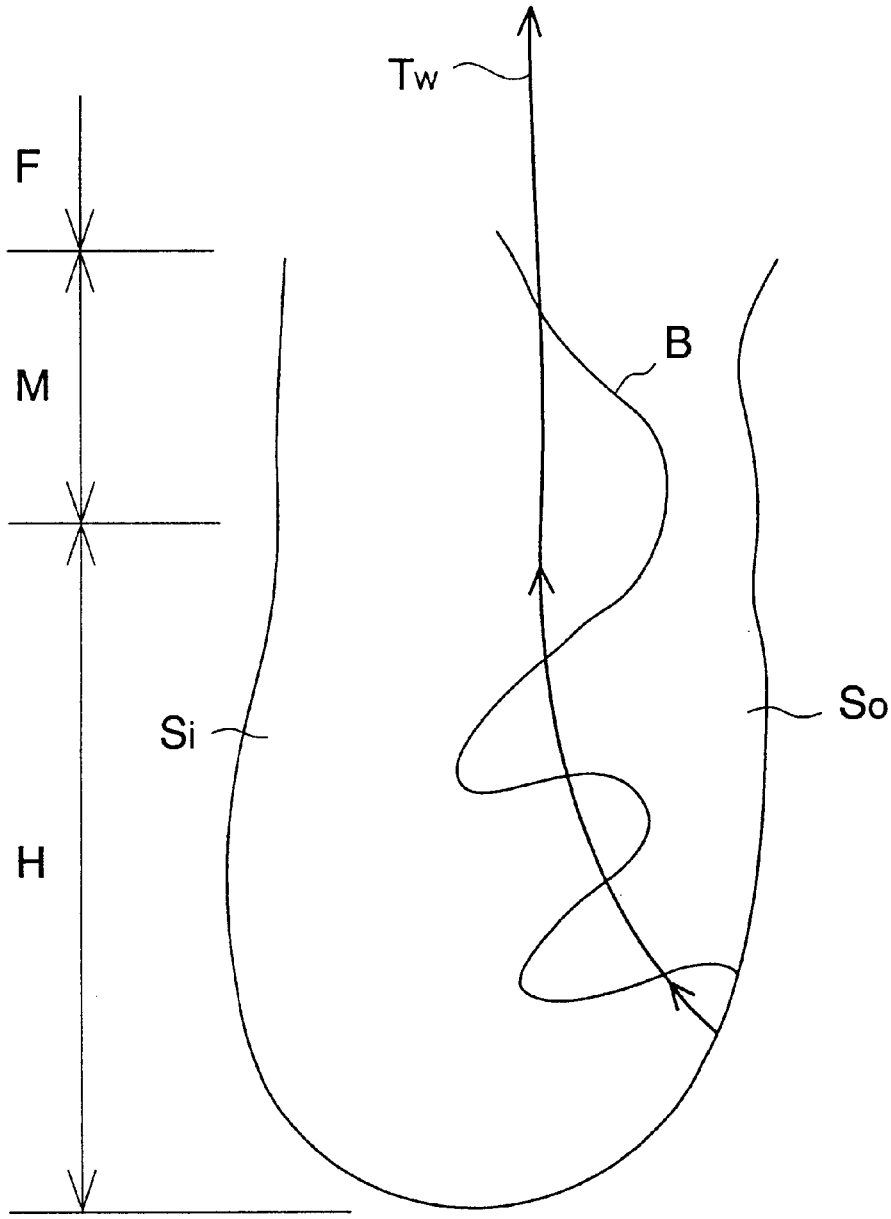
FIG. 11 illustrates a second variant of a boundary line between a medial sheet portion and a lateral sheet portion of the corrugated sheet and corresponds to FIGS. 5 and 9.

FIG. 11 illustrates a second variant of a boundary line. In FIG. 11, like reference symbols indicate identical or functionally similar elements. In this case, a boundary line B between a medial sheet $S_i$ and a lateral sheet $S_o$ crosses the load transfer curve $T_W$ in zigzag at the midfoot portion M and the heel portion H, but deflections of the boundary line B are nearly equal on opposite sides of the load transfer curve $T_W$.

Figure 12B:
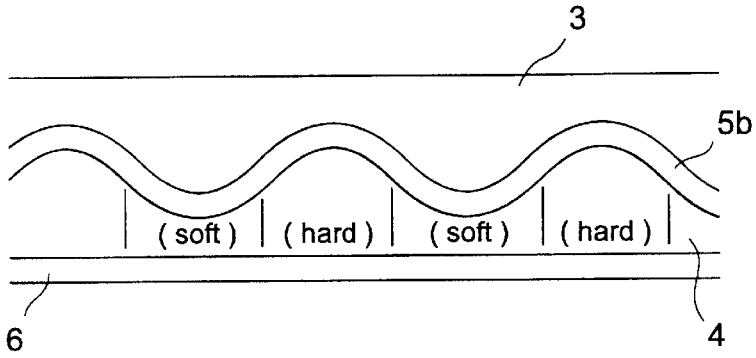
FIG. 12B is a medial side view of the midsole structure and FIG. 12C is a lateral side view of the midsole structure.
Figure 12A:
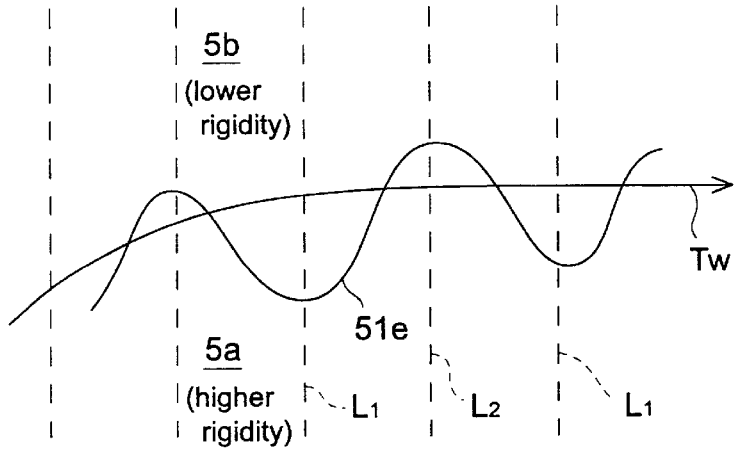
FIG. 12A illustrates a third variant of a boundary line between a medial sheet portion and a lateral sheet portion of the corrugated sheet and corresponds to FIGS. 5 and 9.
Figure 12C:
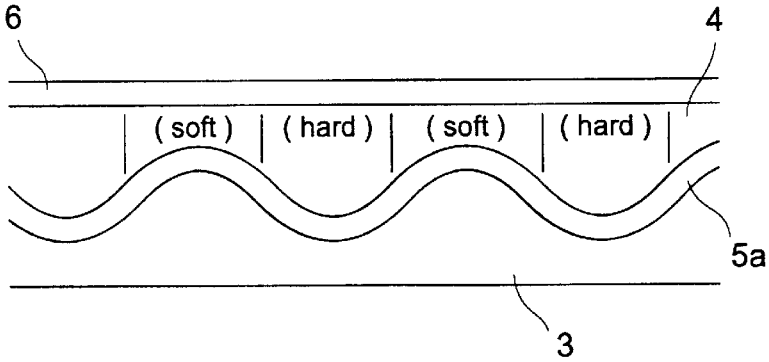

FIGS. 12A to 12C illustrate a third variant of a boundary line. In FIGS. 12A to 12C, like reference numbers indicate identical or functionally similar elements. Generally, in forming a corrugated contact face onto a midsole, a heat-press method of pressing a midsole in a heated condition with a mold having a corrugated surface is often utilized. In the case of such a forming method, crest portions of a wavy corrugation of the midsole have relatively higher density than trough portions of the wavy corrugation of the midsole.

Therefore, as shown in FIGS. 12B and 12C, in a midsole structure having an upper midsole 3, lower midsole 4 and corrugated sheets 5*a,* 5*b,* crest portions of a wavy corrugation of the lower midsole 4 have a relatively higher density and compressive hardness and are hard to deform compressively. Trough portions of a wavy corrugation of the lower midsole 4 have a relatively lower density and compressive hardness and are easy to deform compressively. That is, inside the lower midsole 4, relatively harder regions and softer regions are disposed alternately and repetitively.

In this case, by disposing the edge portion 51*e* of the corrugated sheet 5*b* of a lower rigidity away from the load transfer curve $T_W$ toward the lateral side (or downwardly in FIG. 12A) on and around crest lines L1 of a wavy corrugation, a portion having a relatively lower flexural rigidity in the corrugated sheet is disposed at wider regions on and around the crest lines L1 of the wavy configuration.

On the other hand, by disposing the edge portion 51*e* of the corrugated sheet 5*b* of a lower rigidity away from the load transfer curve $T_W$ toward the medial side (or upwardly in FIG. 12A) on and around trough lines L2 of a wavy corrugation, a portion having a relatively higher flexural rigidity in the corrugated sheet is disposed at wider regions on and around the trough lines L2 of the wavy configuration.

In such a way, flexural rigidity of the corrugated sheet will not change abruptly on opposite sides of the load transfer curve $T_W$. Thus, the way of deformation of the whole midsole structure can be adjusted according to the compressive hardness of the midsole, thereby making a further smooth landing possible at the time of striking onto the ground.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A midsole structure of an athletic shoe comprising:

a midsole having a heel portion, a midfoot portion and a forefoot portion, said midsole being formed of a soft elastic material and extending from a heel region to a forefoot region through a midfoot region of said shoe; and a corrugated sheet having a wavy corrugation and including a medial side portion comprising a first piece of material and a lateral side portion comprising a second piece of material, said corrugated sheet extending from said heel portion to said midfoot portion of said midsole;

wherein a flexural rigidity of said medial side portion of said corrugated sheet is different from that of said lateral side portion of said corrugated sheet; and wherein a boundary line between said medial side portion and said lateral side portion of said corrugated sheet is defined along an edge of one of said pieces of material of said corrugated sheet meeting the other of said pieces of material, and said boundary line crosses a load transfer curve at said midfoot portion of said midsole during a portion of a shoe wearer's gait cycle, which begins with striking onto the ground from said heel region of said shoe and ends with toe-off from said forefoot region of said shoe.

2. The midsole structure of claim 1, wherein said flexural rigidity of said medial side portion of said corrugated sheet is higher than that of said lateral side portion of said corrugated sheet.

3. The midsole structure of claim 1, wherein said flexural rigidity of said lateral side portion of said corrugated sheet is higher than that of said medial side portion of said corrugated sheet.

4. A midsole structure of an athletic shoe comprising:

a midsole having a heel portion, a midfoot portion and a forefoot portion, said midsole being formed of a soft elastic material and extending from a heel region to a forefoot region through a midfoot region of said shoe; and a corrugated sheet having a wavy corrugation and including a medial side portion comprising a first piece of material and a lateral side portion comprising a second piece of material, said corrugated sheet extending from said heel portion to said midfoot portion of said midsole;

wherein a flexural rigidity of said medial side portion of said corrugated sheet is different from that of said lateral side portion of said corrugated sheet; and wherein a boundary line between said medial side portion and said lateral side portion of said corrugated sheet is defined along an edge of one of said pieces of material of said corrugated sheet meeting the other of said pieces of material, and said boundary line crosses a load transfer curve in a zigzag during at least a portion of a shoe wearer's gait cycle, which begins with striking onto the ground from said heel region of said shoe and ends with toe-off from said forefoot region.

5. The midsole structure of claim 4, wherein said boundary line crossing said load transfer curve in said zigzag has an equal amount of deviation on opposite sides of said load transfer curve.

6. The midsole structure of claim 4, wherein said boundary line crossing said load transfer curve in said zigzag has an unequal amount of deviation on opposite sides of said load transfer curve.

7. The midsole structure of claim 4, wherein said flexural rigidity of said medial side portion of said corrugated sheet is higher than that of said lateral side portion of said corrugated sheet.

8. The midsole structure of claim 4, wherein said flexural rigidity of said lateral side portion of said corrugated sheet is higher than that of said medial side portion of said corrugated sheet.

9. A midsole structure of an athletic shoe comprising:

a midsole having a heel portion, a midfoot portion and a forefoot portion, said midsole being formed of a soft elastic material and extending from a heel region to a forefoot region through a midfoot region of said shoe; and a corrugated sheet having a wavy corrugation, said corrugated sheet extending from said heel portion to said midfoot portion of said midsole;

wherein a flexural rigidity of a medial side portion of said corrugated sheet is different from that of a lateral side portion of said corrugated sheet; and wherein a heel portion and a midfoot portion of said corrugated sheet include a medial sheet portion forming said medial side portion thereof and a lateral sheet portion forming said lateral side portion thereof, respective inner edge portions of said medial sheet portion and said lateral sheet portion overlap each other, a boundary line between said medial side portion and said lateral side portion is formed by either one of said edge portions of said medial and lateral sheet portions, and said boundary line crosses a load transfer curve at said midfoot portion of said midsole for a heel striker wearing the athletic shoe.

10. The midsole structure of claim 9, wherein said flexural rigidity of said medial side portion of said corrugated sheet is higher than that of said lateral side portion of said corrugated sheet.

11. The midsole structure of claim 9, wherein said flexural rigidity of said lateral side portion of said corrugated sheet is higher than that of said medial side portion of said corrugated sheet.

12. A midsole structure of an athletic shoe comprising:

a midsole having a heel portion, a midfoot portion and a forefoot portion, said midsole being formed of a soft elastic material and extending from a heel region to a forefoot region through a midfoot region of said shoe; and a corrugated sheet having a wavy corrugation, said corrugated sheet extending from said heel portion to said midfoot portion of said midsole;

wherein a flexural rigidity of a medial side portion of said corrugated sheet is different from that of a lateral side portion of said corrugated sheet; and wherein a heel portion and a midfoot portion of said corrugated sheet are formed by a sheet body and, overlapping a portion of said sheet body, either a lateral sheet portion at said lateral side portion or a medial sheet portion at said medial side portion, a boundary line between said medial side portion and said lateral side portion is formed by an edge portion of said medial sheet portion or said lateral sheet portion, and said boundary line crosses a load transfer curve at said midfoot portion of said midsole for a heel striker wearing the athletic shoe.

13. The midsole structure of claim 12, wherein said flexural rigidity of said medial side portion of said corrugated sheet is higher than that of said lateral side portion of said corrugated sheet.

14. The midsole structure of claim 12, wherein said flexural rigidity of said lateral side portion of said corrugated sheet is higher than that of said medial side portion of said corrugated sheet.

* * * * *